US005426019A

United States Patent [19]

Chari

[11] Patent Number: 5,426,019

[45] Date of Patent: Jun. 20, 1995

[54] COLOR PHOTOGRAPHIC ELEMENT

[75] Inventor: Krishnan Chari, Rochester, N.Y.

[73] Assignee: Eastman Kodak Company, Rochester, N.Y.

[21] Appl. No.: 175,821

[22] Filed: Dec. 30, 1993

[51] Int. Cl.[6] ..... G03C 1/46

[52] U.S. Cl. ..... 430/503; 430/546; 430/551; 430/627; 430/628; 430/631; 430/632; 430/633; 430/639

[58] Field of Search ..... 430/503, 632, 633, 631, 430/627, 628, 639, 546, 551

[56] References Cited

U.S. PATENT DOCUMENTS

| | | | |
|---|---|---|---|
| 3,041,171 | 6/1962 | Wilson et al. | 430/632 |
| 3,516,833 | 6/1970 | Hagge et al. | 430/633 |
| 3,554,755 | 1/1971 | Rinauro | 96/94 |
| 3,676,137 | 7/1972 | Mizuki et al. | 96/56.5 |
| 3,689,271 | 9/1972 | Nittel et al. | 96/84 |
| 3,689,907 | 10/1972 | Sato et al. | 96/84 |
| 3,700,454 | 10/1972 | Sakamoto et al. | 96/100 |
| 3,791,857 | 2/1974 | Balle et al. | 430/533 |
| 4,116,696 | 9/1978 | Tatsuta et al. | 430/533 |
| 4,710,454 | 12/1987 | Langen et al. | 430/542 |
| 4,857,449 | 8/1989 | Ogawa et al. | 430/550 |
| 4,898,810 | 2/1990 | Eggert et al. | 430/531 |
| 5,001,045 | 3/1991 | Furutachi et al. | 430/545 |
| 5,006,453 | 4/1991 | Takahashi et al. | 430/546 |
| 5,043,255 | 8/1991 | Junkers et al. | 430/546 |
| 5,047,316 | 9/1991 | Hirano et al. | 430/546 |
| 5,055,386 | 10/1991 | Hirano | 430/545 |
| 5,135,844 | 8/1992 | Bagchi et al. | 430/546 |
| 5,242,788 | 9/1993 | Takahashi et al. | 430/551 |
| 5,272,046 | 12/1993 | Sasaoka | 430/453 |
| 5,279,931 | 1/1994 | Bagchi et al. | 430/631 |
| 5,300,418 | 4/1994 | Visconte et al. | 430/546 |

FOREIGN PATENT DOCUMENTS

| | | |
|---|---|---|
| 0379893 | 1/1990 | European Pat. Off. . |
| 642936 | 7/1964 | France . |
| 76/28032 | 4/1974 | Japan . |

OTHER PUBLICATIONS

"The Effect of Oxygen Insulation on the Stability of Image Dyes of a Color Photographic Print and the Behavior of Alkylhdroquinones as Antioxidants," *Journal of Applied Photographic Engineering*, vol. 8, No. 5, Oct. 1982, pp. 227–231.

*Primary Examiner*—Thomas R. Neville
*Assistant Examiner*—Geraldine Letscher
*Attorney, Agent, or Firm*—Andrew J. Anderson

[57] ABSTRACT

Yellowing, dye fade and thermal pinking of a processed color photographic element is improved by incorporating into the photographic element a non-color forming, oil-soluble, monomeric or oligomeric organic compound having a glass transition temperature between 0° and 150° C. Preferred organic compounds include rosin derivatives, natural resins and oil-soluble sucrose esters, etc. In a particularly preferred embodiment, the above-noted properties are improved by incorporating into the photographic element an oil-soluble rosin derivative, such as abietic acid.

12 Claims, No Drawings

COLOR PHOTOGRAPHIC ELEMENT

BACKGROUND OF THE INVENTION

This invention relates to a color photographic element having improved image stability.

It is well known that yellowing, dye fade and thermal pinking are major concerns in the image stability of color prints. Over the years improvement in image stability has been achieved by introducing new couplers having a better resistance to dye fade and yellowing and also by introducing more efficient image stabilizers. However, in spite of this, the present level of stability is not considered satisfactory.

It has been known for a number of years that both fading of magenta and yellow image dyes and yellowing of residual magenta coupler are exacerbated by the presence of oxygen. This has led to the search for antioxidants and oxygen barriers. For example, Aono et al, in "The Effect of Oxygen Insulation on the Stability of Image Dyes of a Color Photographic Print and the Behavior of Alkylhydroquinones as Antioxidants" *Journal of Applied Photographic Engineering*, Volume 8, (1982) pp 227–231, indicate that improvements in dye fade and yellowing may be obtained by laminating a color print using polyethylene terephthalate. However, lamination is an expensive and laborious process.

Couplers are usually incorporated into photographic materials by dissolving the coupler in a high boiling organic solvent, optionally with a low boiling water immiscible auxiliary solvent, and then dispersing the resulting solution as an oil phase in an aqueous medium which generally contains a hydrophilic colloid, such as gelatin. Several recent patents suggest that improvements in image stability may be obtained by incorporating hydrophobic polymers in the oil phase of such dispersions. See for example, U.S. Pat. Nos. 4,710,454; 4,857,449; 5,001,045; 5,006,453; 5,043,255; 5,047,316; and 5,055,386. Many of these polymers have good oxygen insulating properties in the glassy state. However, the presence of high molecular weight polymers generally results in very high viscosities for the oil phase leading to large particle size and a subsequent decrease in dye density. The latter may be circumvented by using large amounts of a low boiling auxiliary solvent, such as ethyl acetate, which is then removed by evaporation, but this raises serious environmental concerns and adds additional expense.

PROBLEM TO BE SOLVED BY THE INVENTION

There is therefore a need for materials that can improve image stability when incorporated in the oil phase of dispersions without the disadvantages encountered with the use of high molecular weight polymers.

SUMMARY OF THE INVENTION

One aspect of this invention comprises a silver halide color photographic element comprising at least one layer comprising water, a hydrophilic colloid and at least one non-color forming, oil-soluble, monomeric or oligomeric organic compound having a glass transition temperature between 0° and 150° C.

Another aspect of this invention comprises a method of improving the image stability of a silver halide color photographic element comprising at least one layer comprising water and a hydrophilic colloid, which method comprises incorporating in said layer at least one non-color forming, oil-soluble, monomeric or oligomeric organic compound having a glass transition temperature between 0° and 150° C.

A further aspect of this invention comprises a method of improving the image stability of a silver halide color photographic element comprising at least on layer comprising water and a hydrophilic colloid, which method comprises incorporating in said layer a material selected from rosin or a derivative thereof. Particularly preferred rosin derivatives are compounds of the formula:

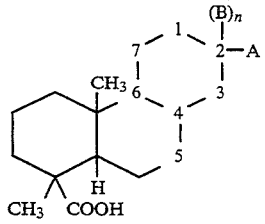

where A is a saturated or unsaturated alkyl group of 1–10 carbons and B is a hydrogen atom or a saturated or unsaturated alkyl group of 1–10 carbons and n is 0 or 1. Bonds between the numbered corners of the ring structure can be single or double bonds.

ADVANTAGEOUS EFFECTS OF THE INVENTION

This invention provides a silver halide based color photographic element having excellent image stability in terms of yellowing, dye fade and thermal pinking.

DETAILED DESCRIPTION OF THE INVENTION

In accordance with preferred embodiments of this invention, a low molecular weight organic glass is incorporated into a layer of a color photographic element.

In this specification, the term "low molecular weight organic glass" refers to any non-color forming, oil-soluble, monomeric or oligomeric organic compound having a glass transition temperature between 0° C. and 150° C. preferably 0° C. and 100° C. The organic glass preferably has a molecular weight below about 1000, preferably below about 500. Furthermore, the organic glass should be miscible with organic solvents commonly used in preparing photographic elements, such as dibutyl phthalate or tricresyl phosphate.

Preferred organic glass materials for use in this invention are oil soluble gums, rosins, natural resins and their derivatives, esters of lactose, oil soluble galactomannons, glycol esters, naturally occurring esters of oligomeric glycol esters, alkylbetaglycoside ethers, where the alkyl group contains at least 8 carbon atoms, and water-insoluble derivatives of sucrose, including sucrose esters, and polyesters, esterified sugars or sugar alcohols, such as erythritol, xylitol, sorbitol, glucose or sucrose, esterified with at least four fatty acid groups, such as caprylic, capric, lauric myristic, myristoleic, palmitic, palmitoleic, stearic, oleic, ricinoleic, linoleic, linolenic, eleostearic, etc.; and esterified alkoxylated sugar or sugar alcohols esterified with at least four fatty acid groups. Oil-soluble gums, rosins, natural resins and their derivatives including, for example, rosin acids, such as abietic acid, neoabietic acid, palustric acid, pimaric acid, isopimaric acid, levopimaric acid, hydrogenated rosin acids; and salts, esters and amides of such acids; natural resins, such as damar, East India (pale or black), pine gum, pontiniak, Manila, elemi, yacca (accroides), gilsonite, gum rosin, wood rosin, and tall oil rosin. Many rosin derivatives are commercially available from Hercules, Incorporated of Wilmington Delaware under the trade marks Foral®, Poly-Pale®, Staybellite®, Pamite® and numerous others.

One class of preferred organic glass materials comprises oil-soluble sucrose esters, such as sucrose octaacetate. Another class of preferred organic glass materials comprises rosin and derivatives thereof.

The mechanism by which yellowing, dye fade and thermal pinking is inhibited is not entirely understood. While it is believed that the effectiveness of the material added is due to its glassy characteristics, it is also contemplated that the particular effectiveness of rosin and derivatives thereof might be due to chemical characteristics or other physical properties.

In certain preferred embodiments of the invention, rosin, or derivative thereof, is incorporated into the photographic element. Preferred rosin derivatives have the structure:

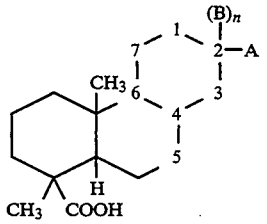

where A is a saturated or unsaturated alkyl group of 1–10 carbons and B is a hydrogen atom or a saturated or unsaturated alkyl group of 1–10 carbons and n is 0 or 1. Bonds between the numbered corners of the ring structure can be single or double bonds.

Specific examples of rosins of the above formula which can be utilized in the present invention are given below. It is understood that this list is representative only, and not meant to be exclusive.

| Compound | A | $(B)_n$ | double bonds | name |
|---|---|---|---|---|
| R-A | isopropyl | n = 0 | 2-3, 4-5 | abietic acid |
| R-B | isopropyl | n = 0 | 1-2, 3-4 | levopimaric acid |
| R-C | isopropyl | n = 0 | 2-3, 4-6 | palustric acid |
| R-D | isopropyl | n = 0 | 1-2, 3-4, 6-7 | dehydroabietic acid |
| R-E | isopropyl | H (n = 1) | none | tetrahydroabietic acid |
| R-F | isopropylidene | H (n = 1) | 3-4 | neoabietic acid |
| R-G | vinyl | methyl (n = 1) | 3-4 | pimaric acid |
| R-H | vinyl | methyl (n = 1) | 4-5 | isopimaric acid |
| R-I | vinyl | methyl (n = 1) | 4-6 | isopimaric acid |

Particularly preferred is abietic acid which has the structural formula:

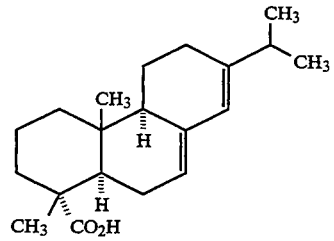

R-A (abietic acid) Tg~65° C.

Color photographic elements are typically multilayer elements comprising a plurality of layers coated on a support, at least one of which is light sensitive. The organic glass may be incorporated into any layer of the photographic element. The organic glass is incorporated into a layer by forming a dispersion of the organic glass and a high boiling organic solvent, such as dibutyl phthalate or tricresyl phosphate, in an aqueous medium, preferably containing a hydrophilic colloid. The dispersion is then coated onto a support to form a layer.

It is to be understood that mixtures of organic glass compounds and/or rosin or rosin derivatives can be used. Preferably the amount of organic glass and/or rosin or rosin derivative used in a photographic element of this invention is between about 0.001 to about 1.72 $g/m^2$.

An oil-soluble polymer may also be incorporated into the photographic element. The oil-soluble polymer is added to an oil phase of a photographic dispersion used in the preparation of the element. In preferred embodiments the oil-soluble polymer is added to the same dispersion as the organic glass (or rosin or rosin derivative). Illustrative oil-soluble polymers are disclosed in above noted U.S. Pat. Nos. 4,710,454; 4,857,449; 5,001,045; 5,006,453; 5,043,255; 5,047,316; and 5,055,386, the disclosures of which are incorporated herein by reference.

Typically, color photographic elements comprise at least one layer sensitive to red light and comprising a silver halide emulsion and a cyan dye forming coupler, at least one layer sensitive to green light and comprising a silver halide emulsion and a magenta dye forming coupler and at least one layer sensitive to blue light and comprising a silver halide emulsion and a yellow dye forming coupler. The light sensitive layers can be in any desired order. The organic glass may be incorporated in the dispersed oil phase of one of said light sensitive layers or in a non-light sensitive layer of the photographic element, for example an interlayer positioned between light sensitive layers, a filter layer, a subbing layer, an antihalation layer, an overcoat layer, or the like.

When used in a light sensitive layer, the organic glass material may be incorporated as an addendum to the oil phase of a dispersion of one of the couplers, preferably the magenta or yellow coupler. In this case, the organic glass, coupler and high boiling permanent solvent are heated to form a solution which is then added to an aqueous medium containing a hydrophilic colloid. This dispersion is then added to the silver halide emulsion prior to coating onto a support in the manufacture of the photographic element.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND.

In the following discussion of suitable materials for use in the elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961). Such couplers are typically open chain ketomethylene compounds.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

Typical couplers and stabilizers that can be used in the elements of this invention are shown below.

-continued
M-1
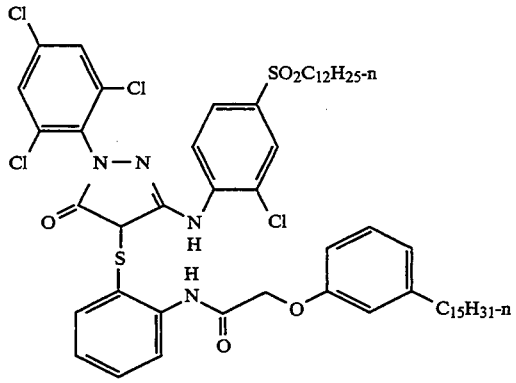
M-2
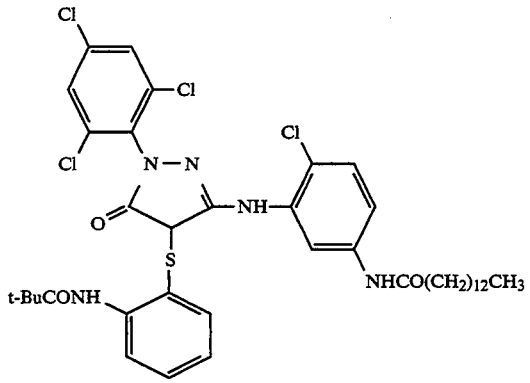
M-3
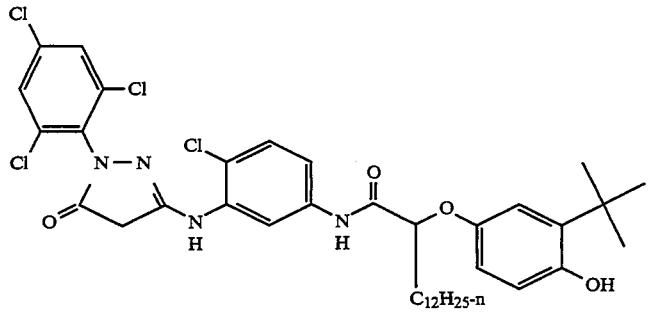
M-4
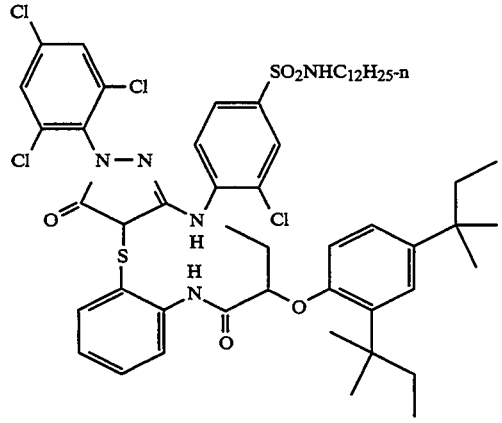

-continued
M-5
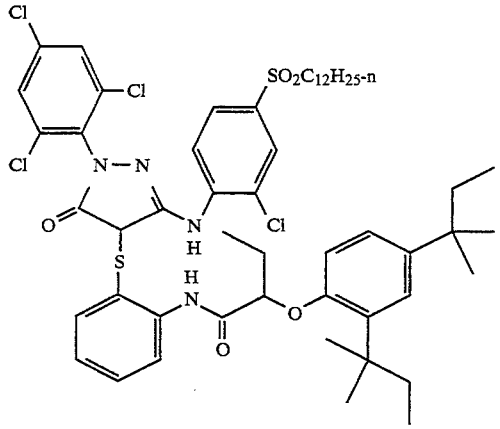
M-6
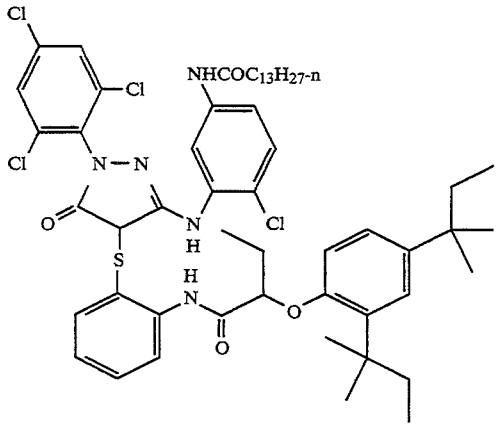
M-7
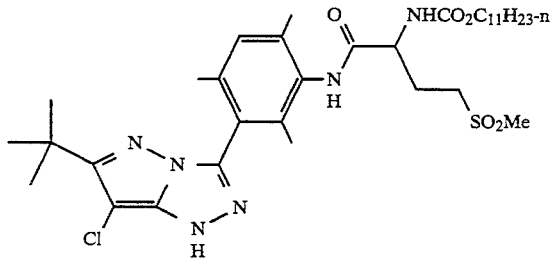
M-8
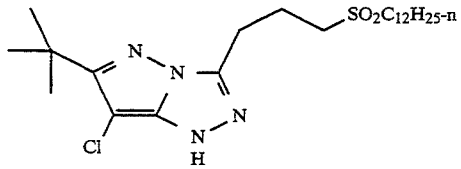
M-9
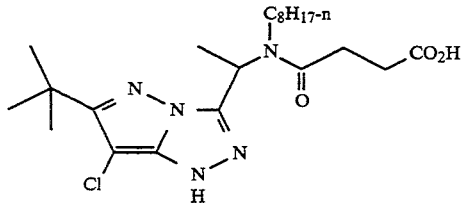

-continued
M-10
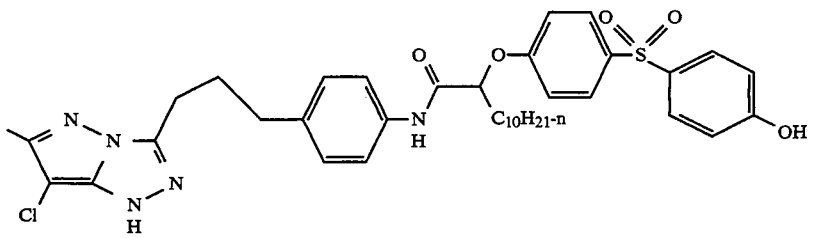
M-11
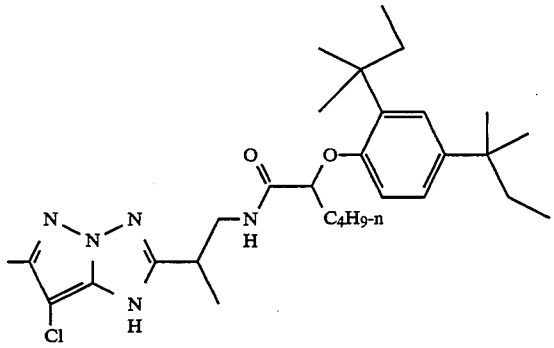
M-12
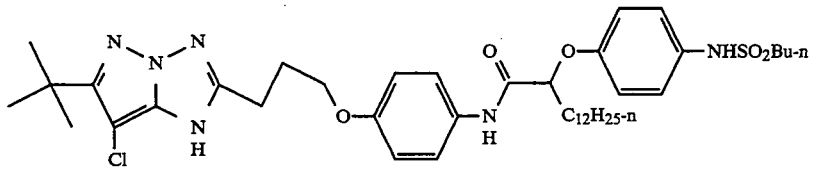
M-13
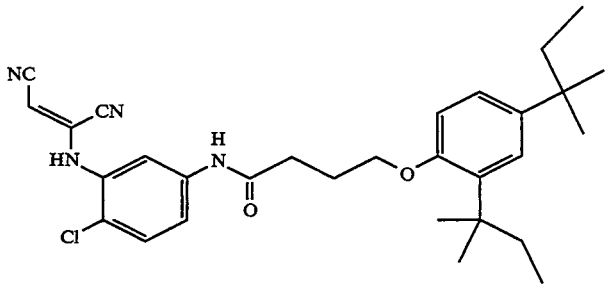
M-14
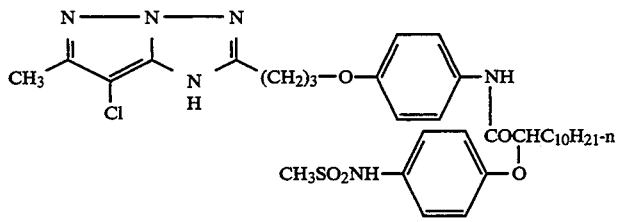
M-15
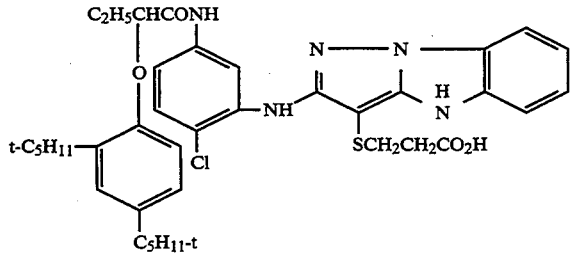

-continued
M-16
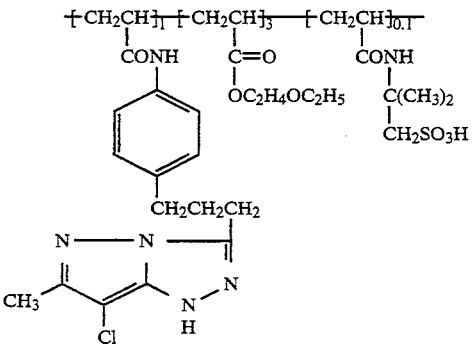
M-17
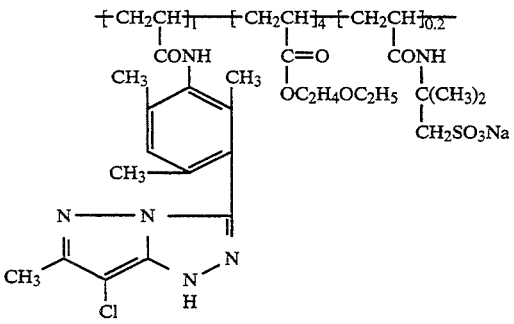
M-18
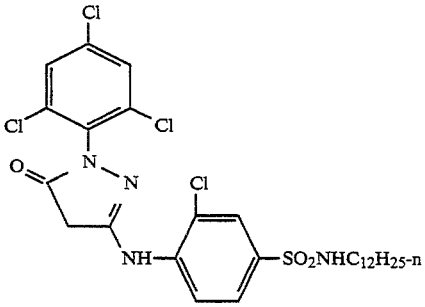
M-19
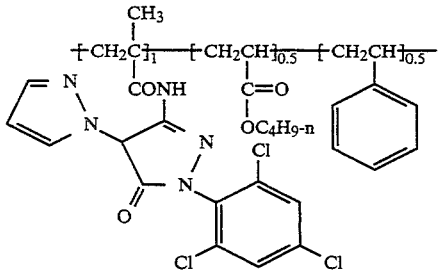
M-20
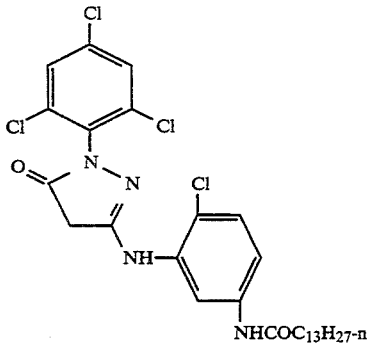

-continued
M-21
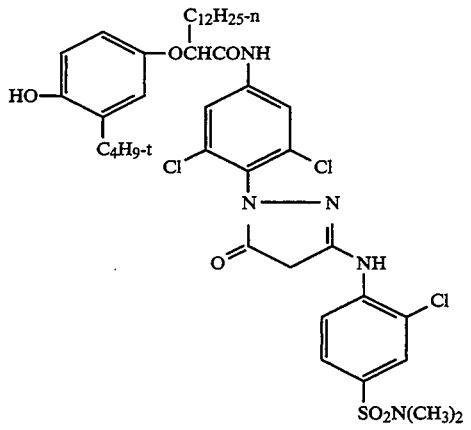
M-22
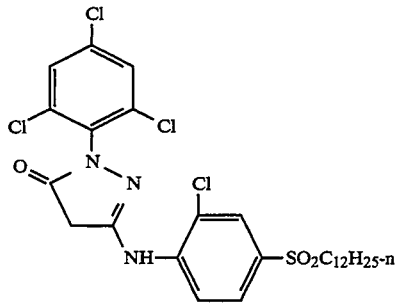
M-23
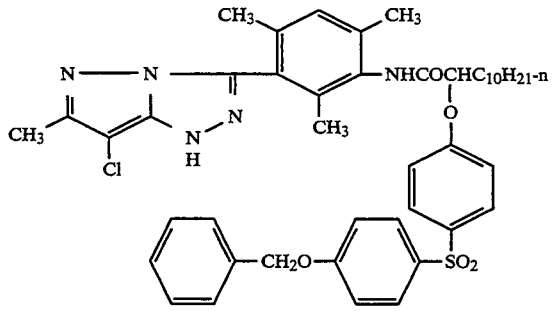
M-24
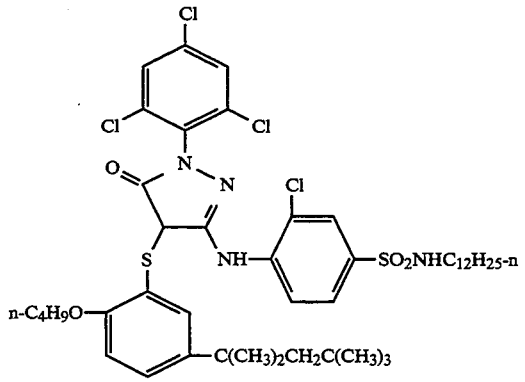

-continued
M-25
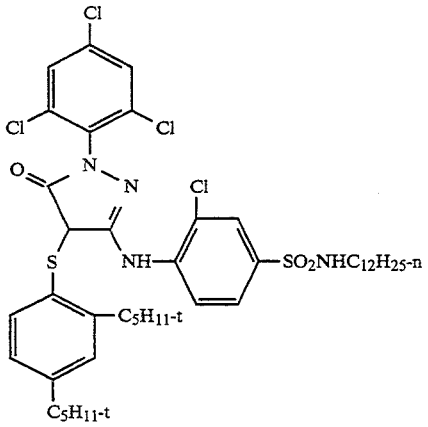
M-26
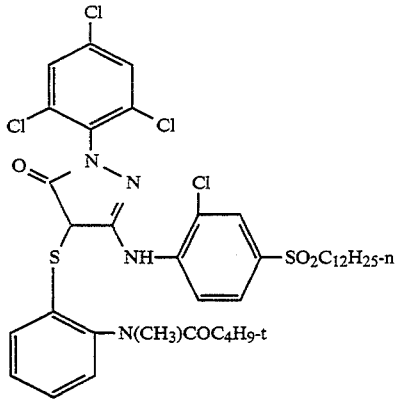
M-27
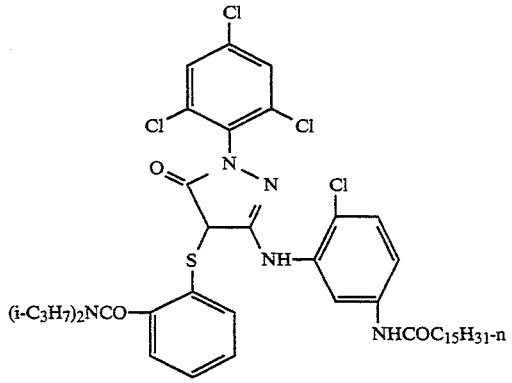
M-28
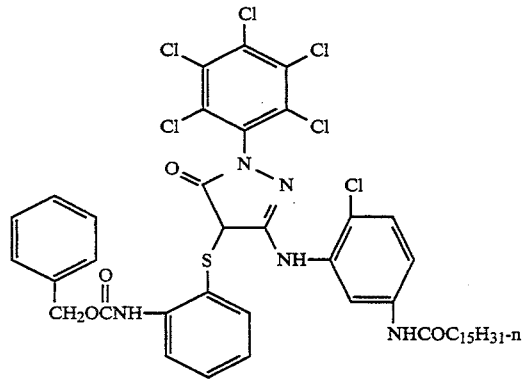

-continued
M-29
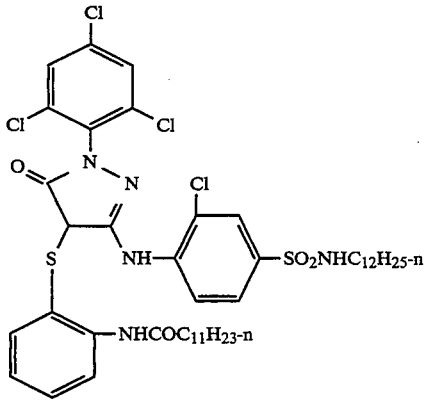
M-30
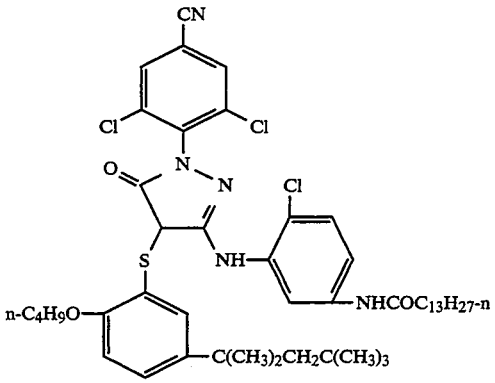
M-31
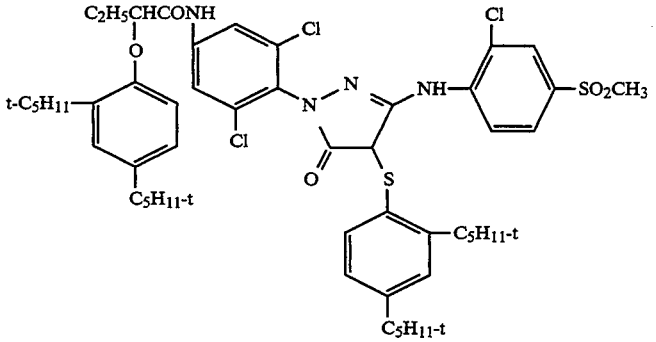
M-32
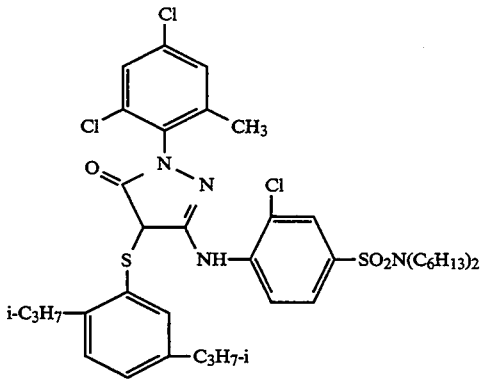

-continued
M-33
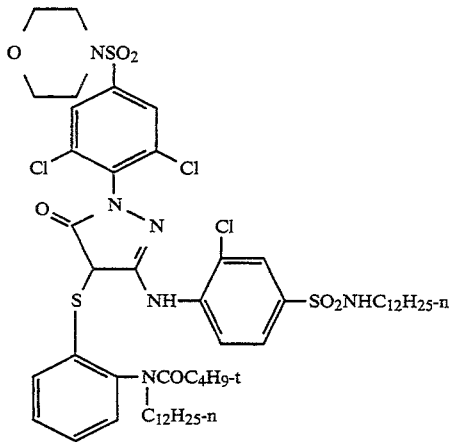
M-34
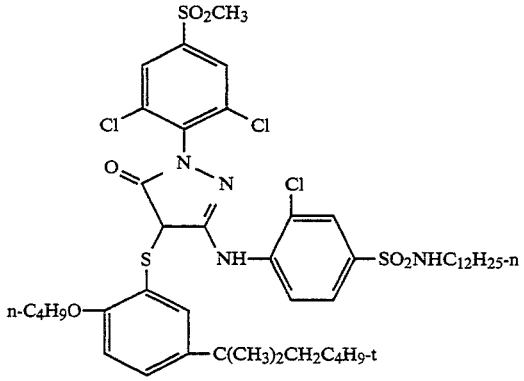
M-35
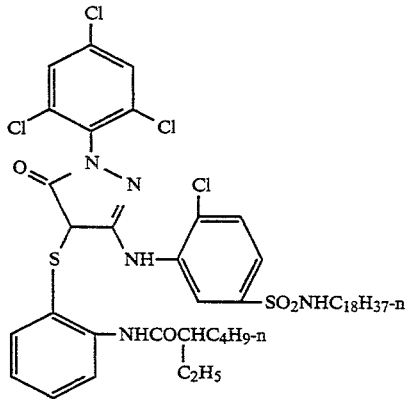
M-36
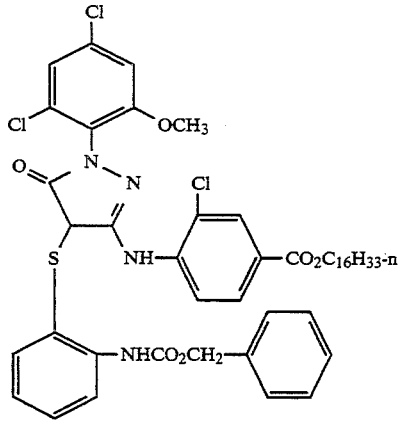

-continued
M-37
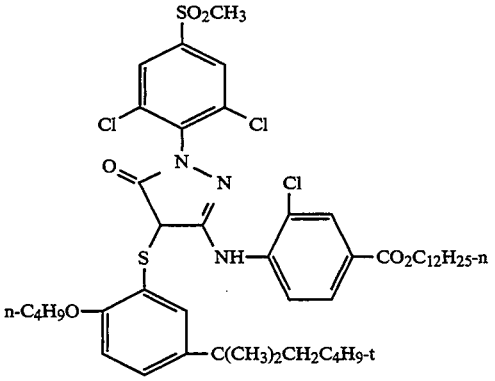
M-38
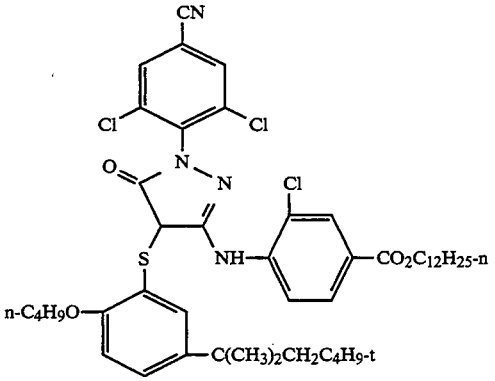
M-39
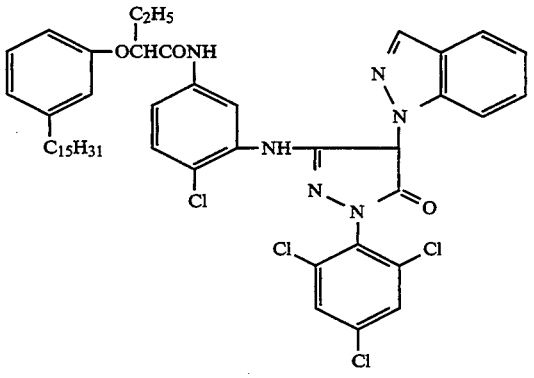
M-40
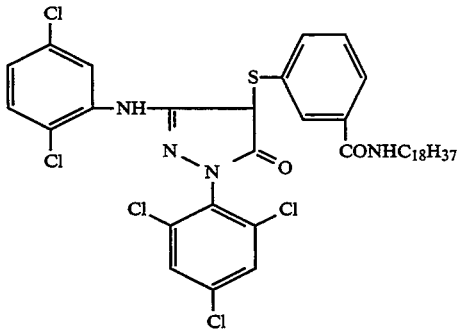

-continued
M-41
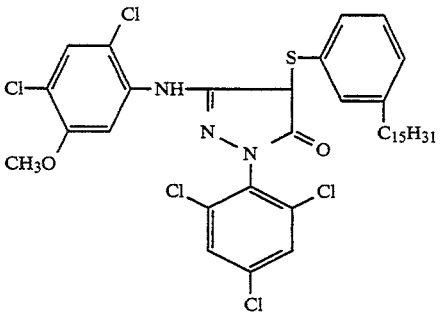
M-42
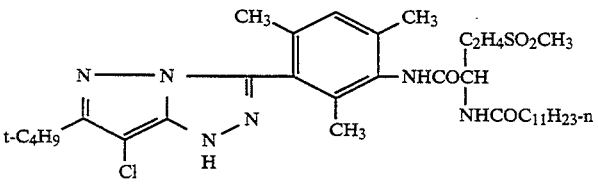
Yellow Couplers
Y-1
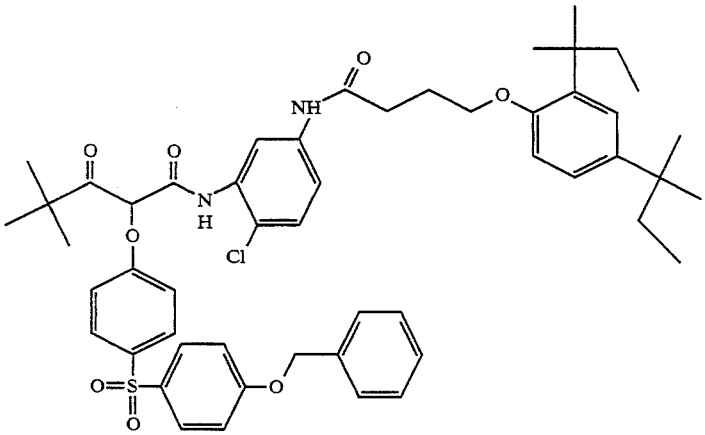
Y-2
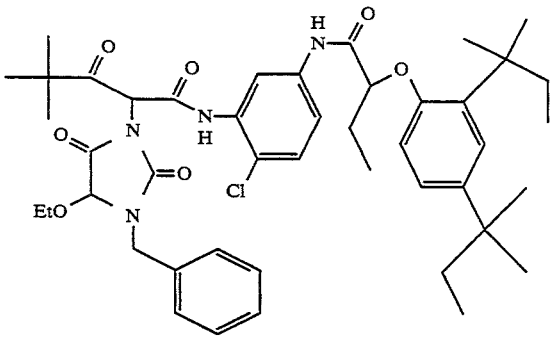

-continued
Y-3
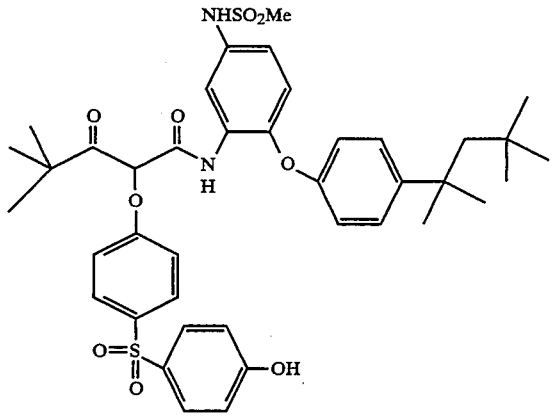
Y-4
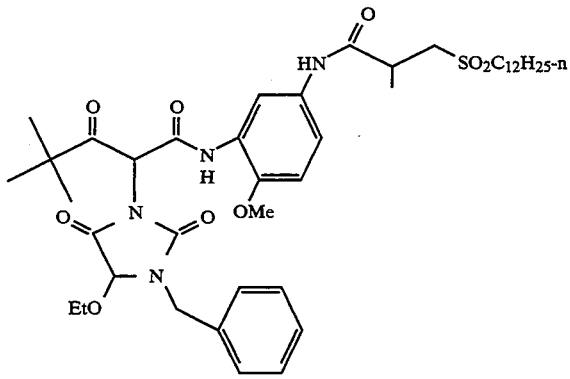
Y-5
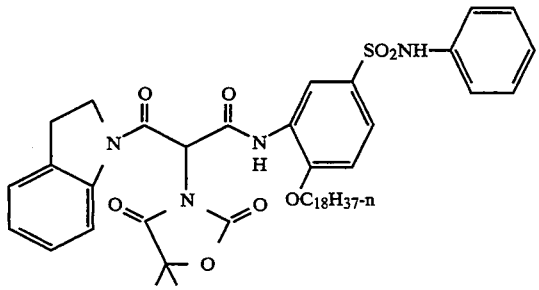
Y-6
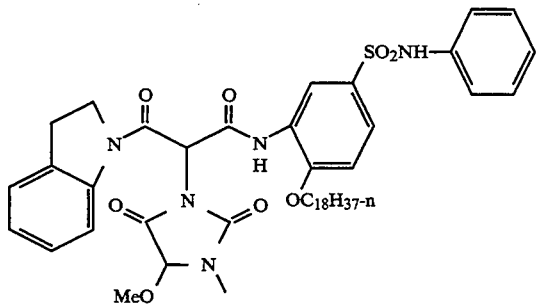
Y-7
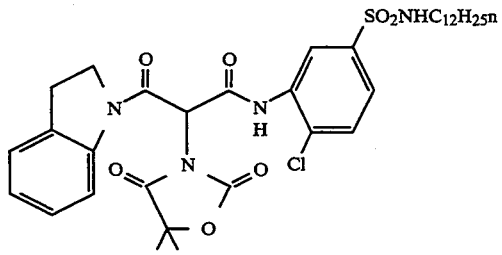

-continued
Y-8
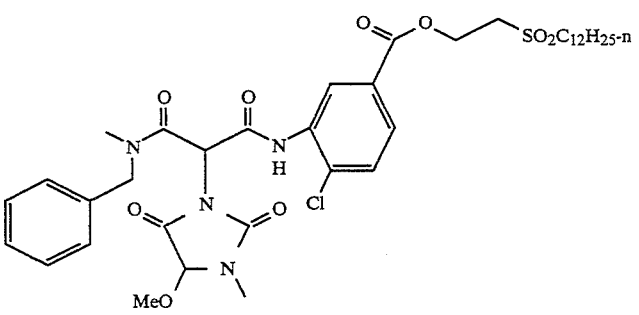
Y-9
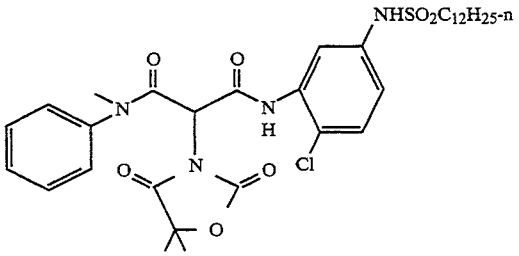
Y-10
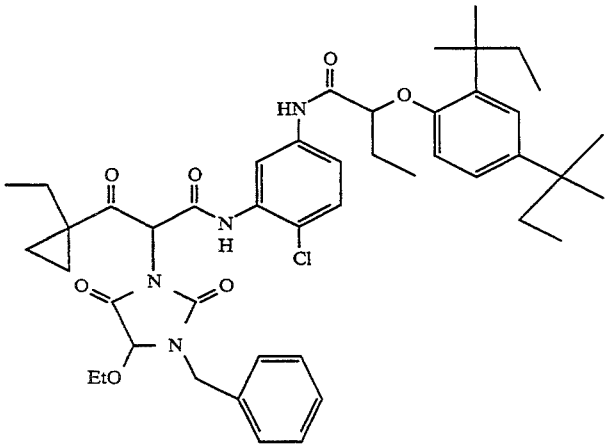
Y-11
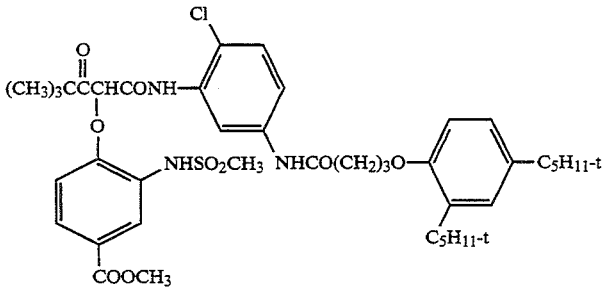
Y-12
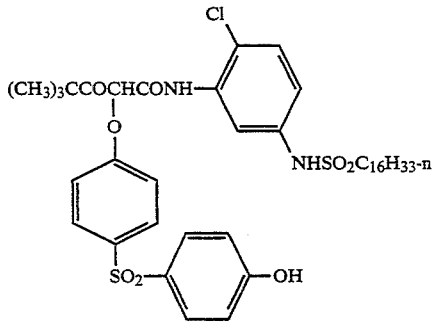

-continued
Y-13
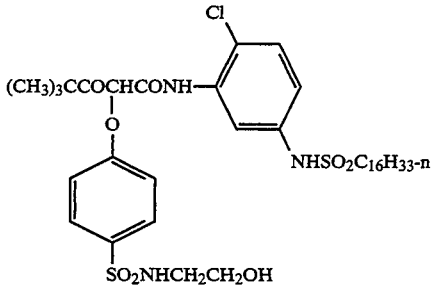
Y-14
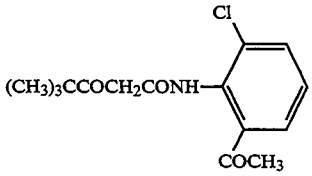
Y-15
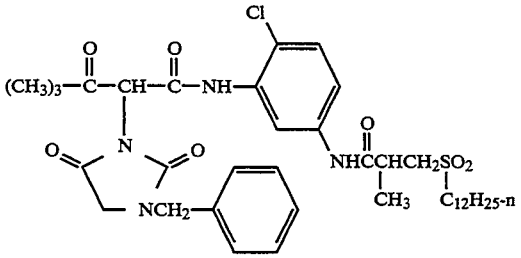
Y-16
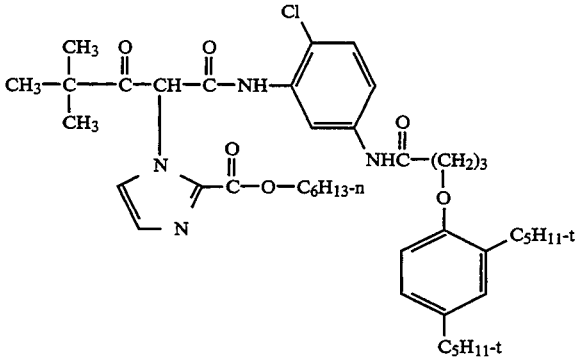
Y-17
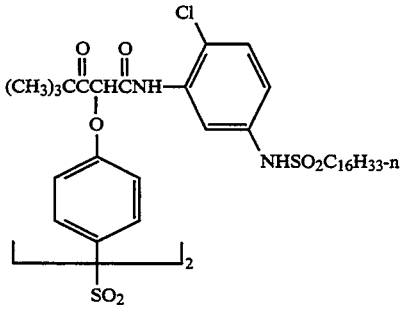

-continued
Y-18
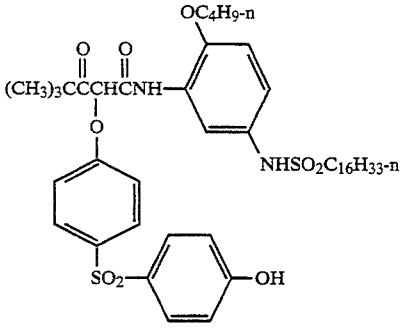
Y-19
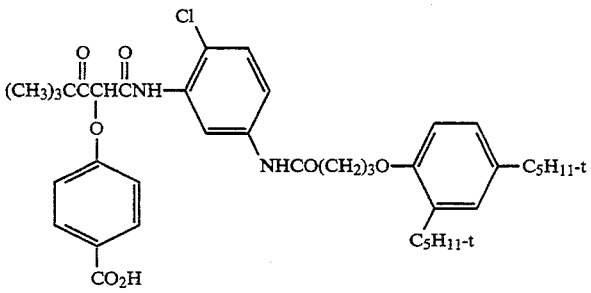
Y-20
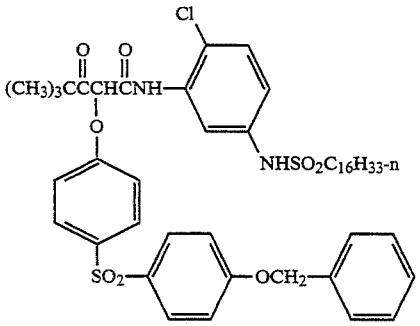
Y-21
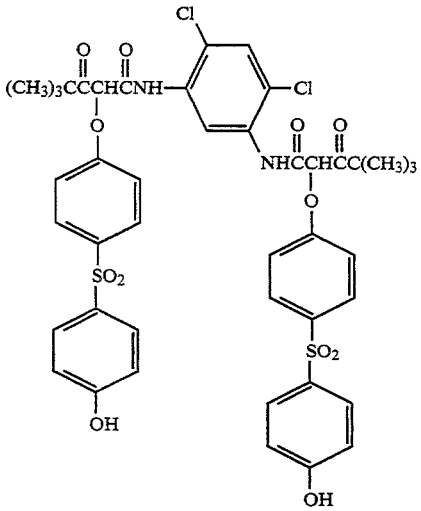
Y-22
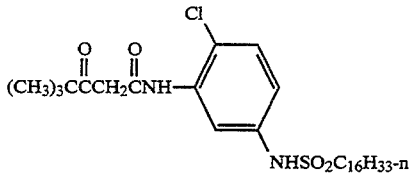

-continued
Y-23
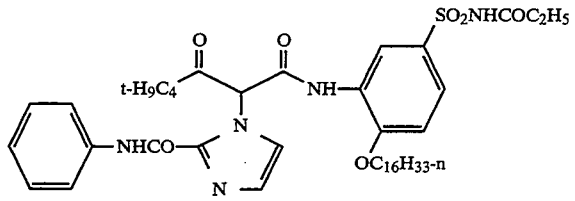
Y-24
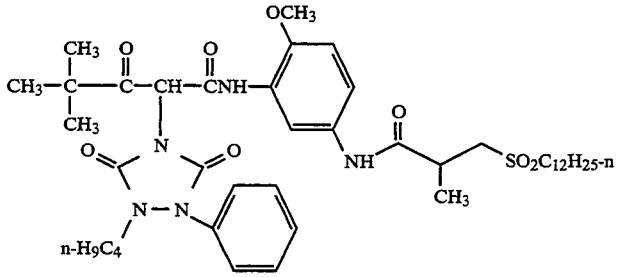
Y-25
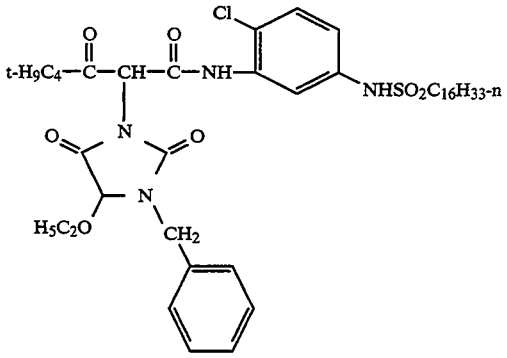
Y-26
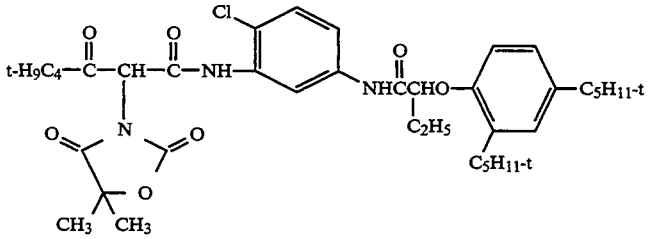
Y-27
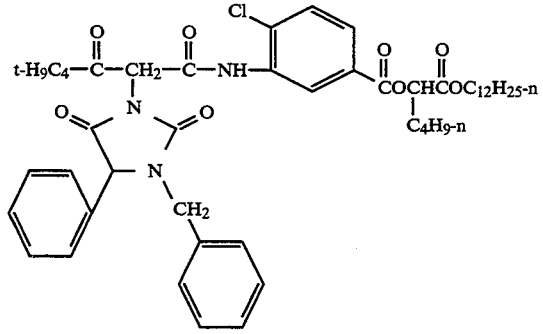

-continued
Y-28
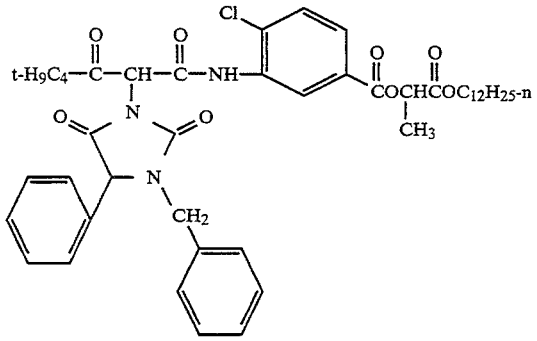
Y-29
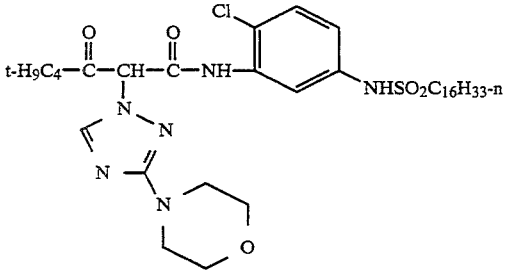
Y-30
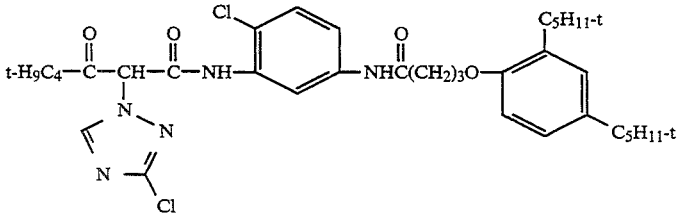
Y-31
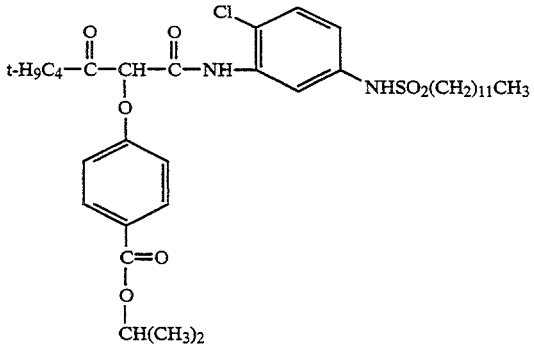
Y-32
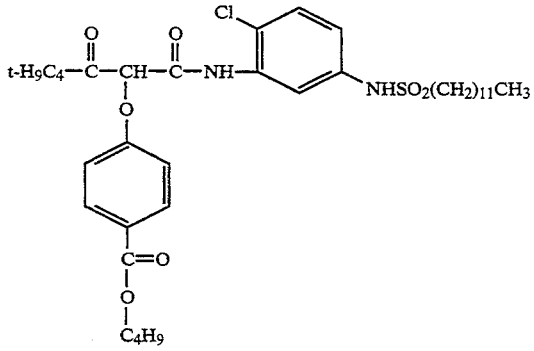

-continued
Y-33
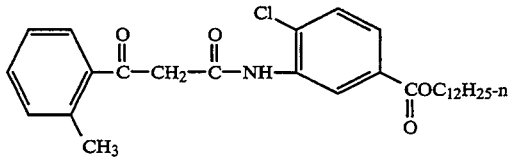
Y-34
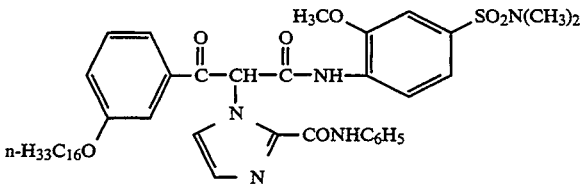
Y-35
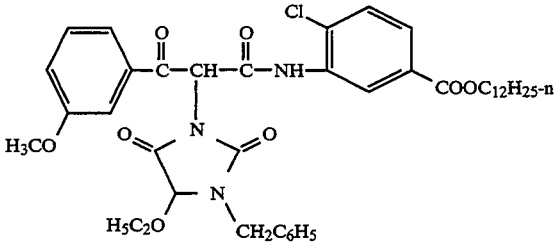
Y-36
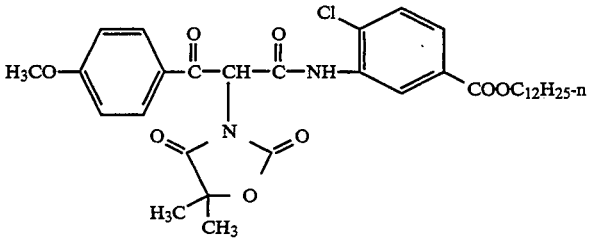
Y-37
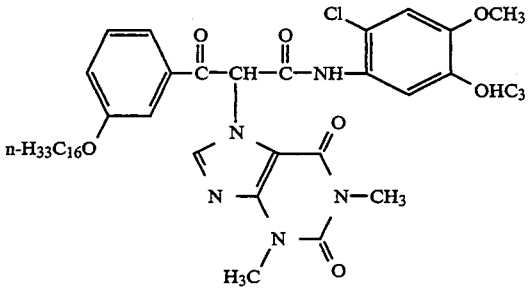
Y-38
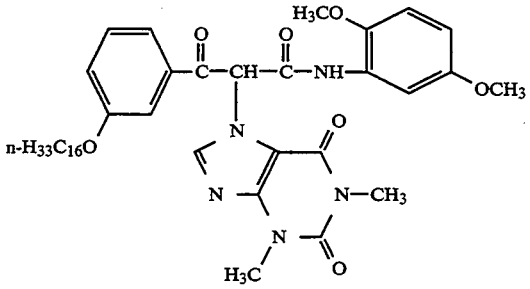
Y-39
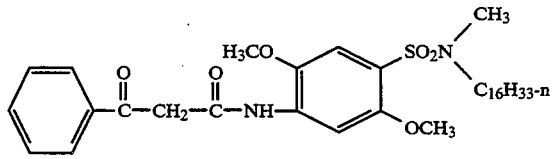

-continued
Y-40
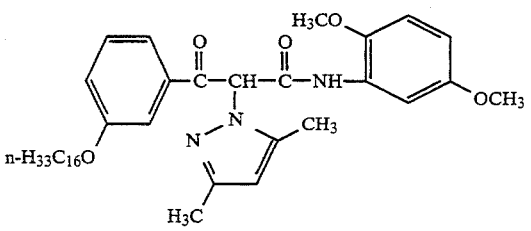
Y-41
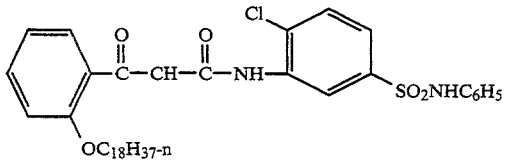
Y-42
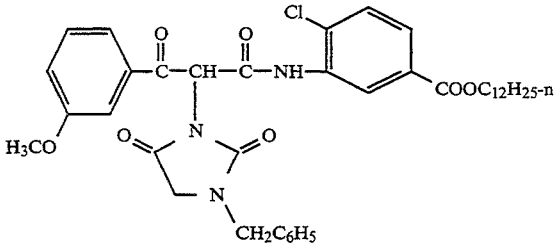
Y-43
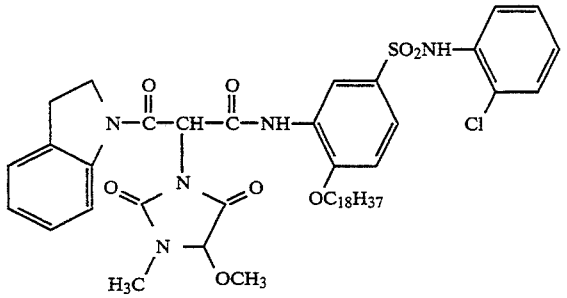
Y-44
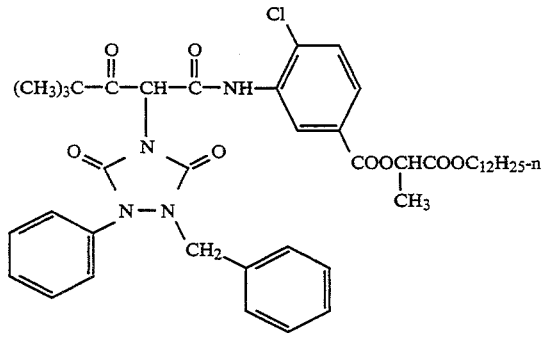
Y-45
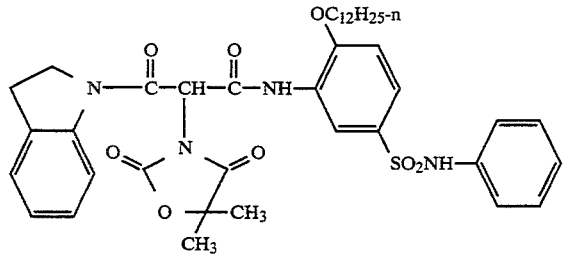

-continued
Y-46
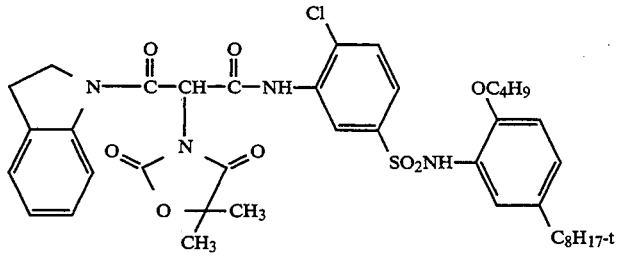
Y-47
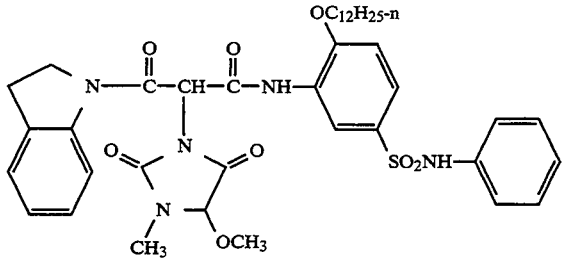
Y-48
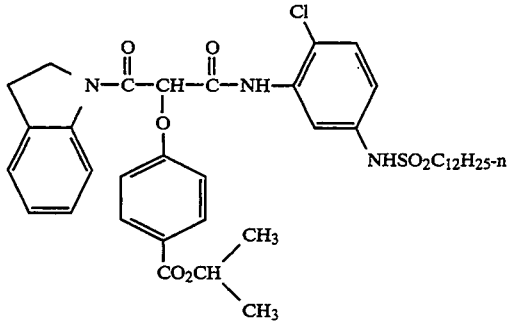
Y-49
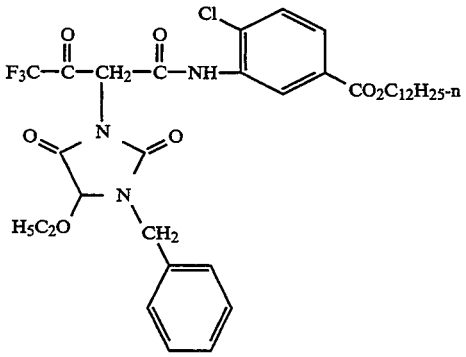
Y-50
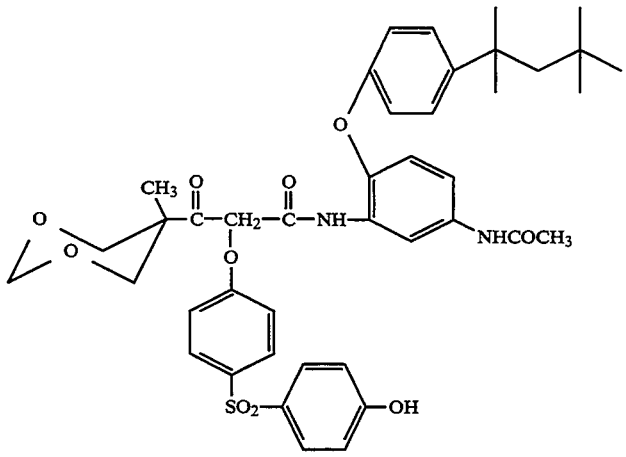

-continued
Cyan Couplers
C-1
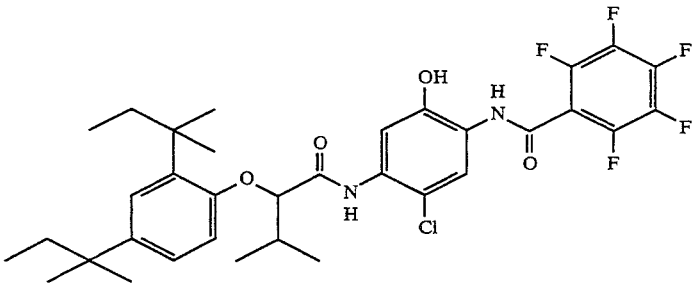
C-2
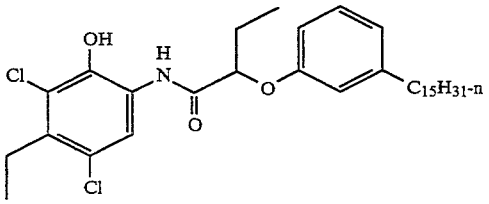
C-3
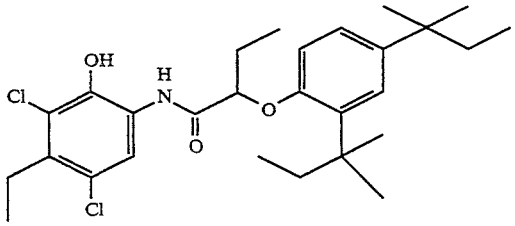
Stabilizers
ST-1
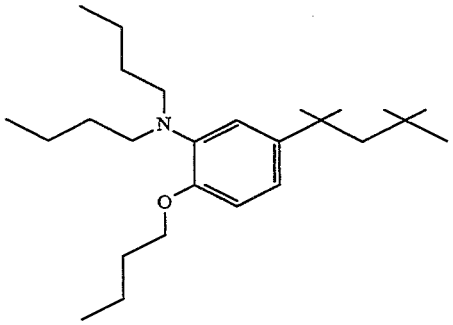
ST-2
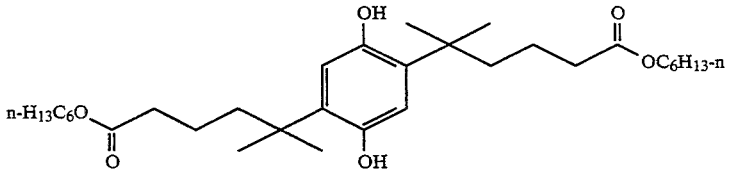

-continued
ST-3
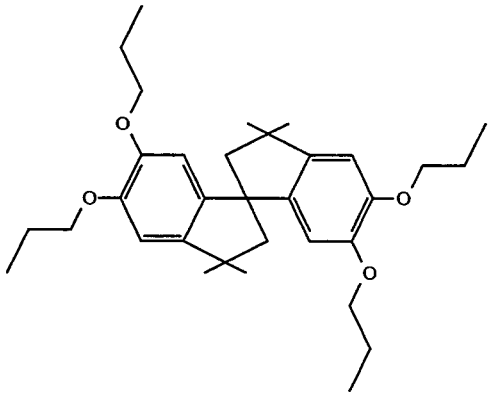
ST-4
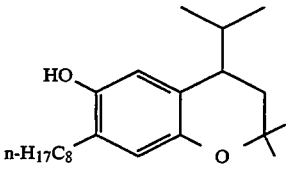
ST-5
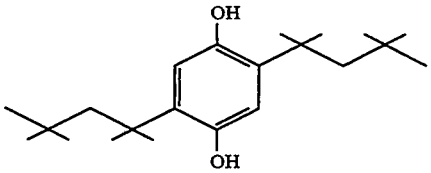
ST-6
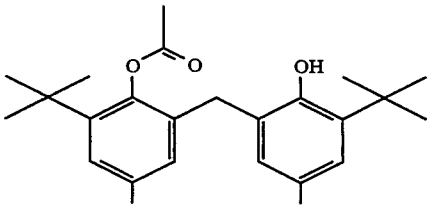
ST-7
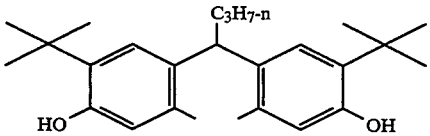
ST-8
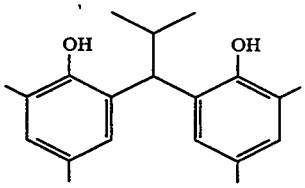
ST-9
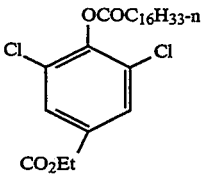

-continued

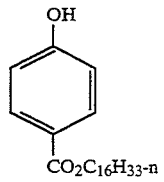

ST-10

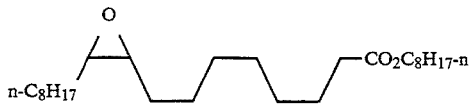

ST-11

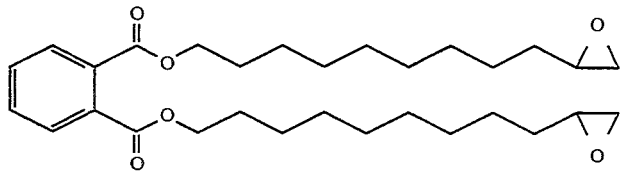

ST-12

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl)ethyl(3-chloro-4-((3-(2-chloro-4-((1-tridecanoylethoxy)carbonyl-)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl-)amino)-N-(4,5-dihydro-5-oxo-l-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)-propyl)amino)carbonyl)-5-hydroxy-1-naphthalenyl)-, 2-methylpropyl ester, "Coupler 7". Acetic acid, ((2-((3-(((3-(dodecyloxy)propyl-)amino)carbonyl)-4-hydroxy-8-(((2-methylpropoxy)carbonyl)amino)-1-naphthalenyl)oxy)ethyl)thio)-, and "Coupler 8" Benzamide, 3-((2-(2,4-bis(1,1-dimethylpropyl)phenoxy)-1-oxobutyl)amino)-N-(4,5-dihydro-4-((4-methoxyphenyl)azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)-carbonyl)-4-hydroxy-1-naphthalenyl)oxy)ethoxy)-phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)-phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl-)amino)carbonyl)-3,3-dimethyl-2-oxobutoxy)-, 1-methylethyl ester; a mid yellow layer containing Coupler 1 and "Coupler 2": Benzoic acid, 4-chloro-3 [[2-[4-ethoxy-2,5-dioxo-3-(phenylmethyl)-1-imidazolidinyl]-4,4-dimethyl-1,3-dioxopentyl-]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)-phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl-)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

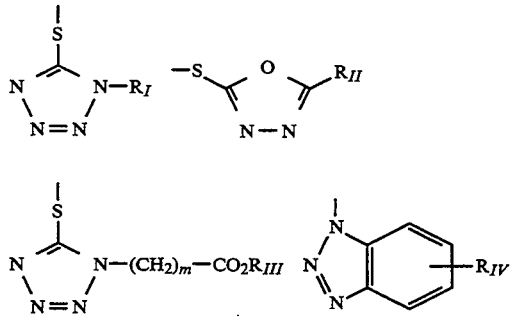

-continued

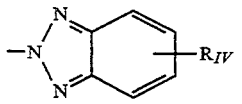

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat No. 4,618,571) and groups that combine the features describe above. It is typical that the timing group or moiety is of one of the formulas:

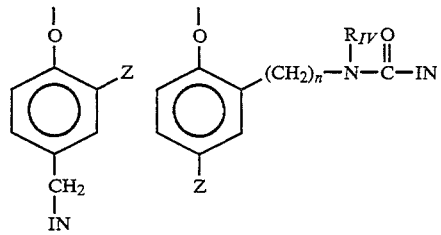

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

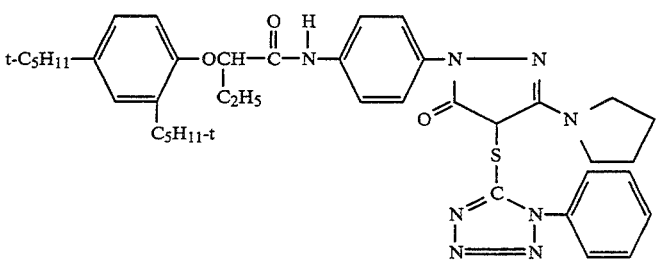

D2

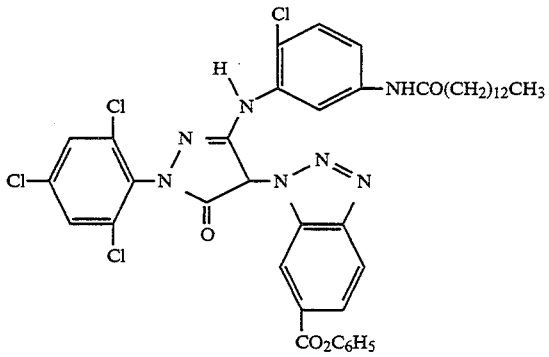

-continued
D3
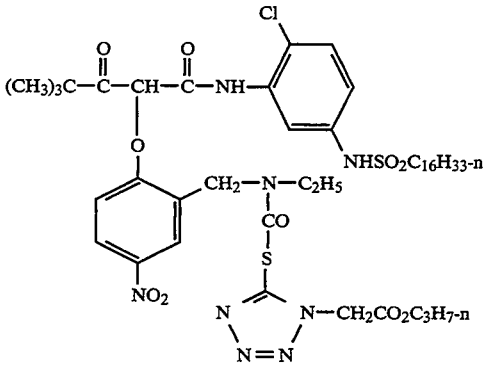
D4
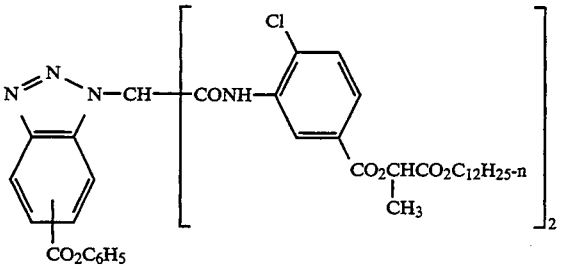
D5
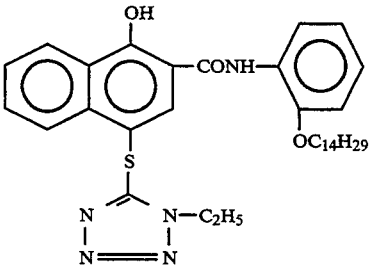
D6
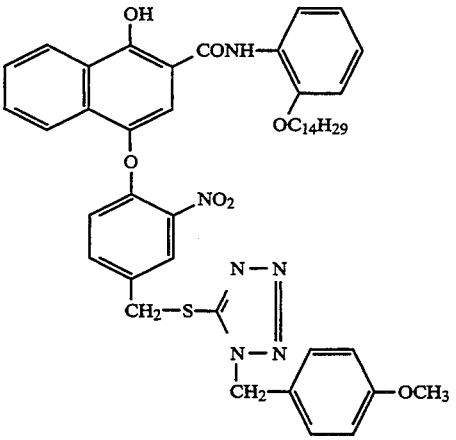

-continued

D7

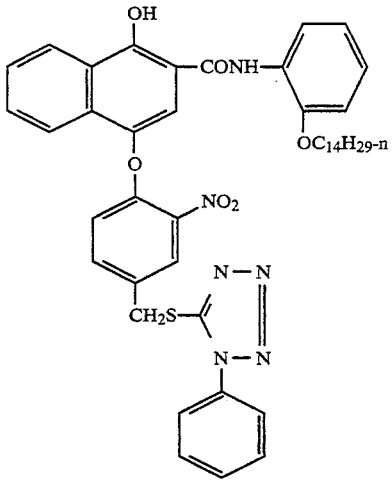

D8

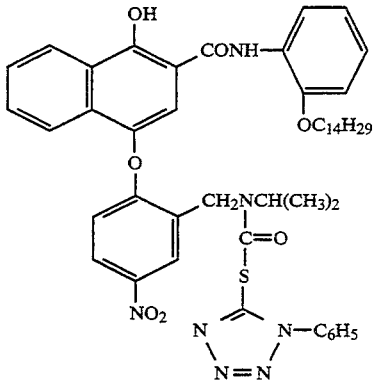

D9

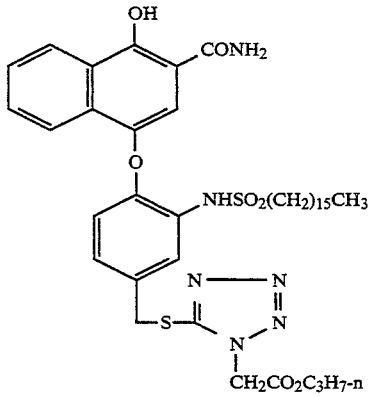

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in European patent publication No. 543,395 are specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleachfixing, to remove silver or silver halide, washing, and drying.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

The following examples illustrate the invention.

Preparation of Dispersion 1 (comparative):

A dispersion of the magenta coupler M-1 was prepared in the following manner. 3.4 grams of dibutyl phthalate was heated to 140° C. in a heating mantle. 3.4 grams of the coupler was then dissolved in the solvent to constitute the oil phase. The aqueous phase was prepared by combining 44 grams of 11.36% w/w solution of Type IV gelatin in water with 5.0 grams of a 10% w/w solution of the surfactant Alkanol XC TM and 44.2 grams of distilled water at 65° C. The aqueous phase was then combined with the oil phase and the mixture was passed twice through a microfluidizer at 7300 psi to obtain the dispersion.

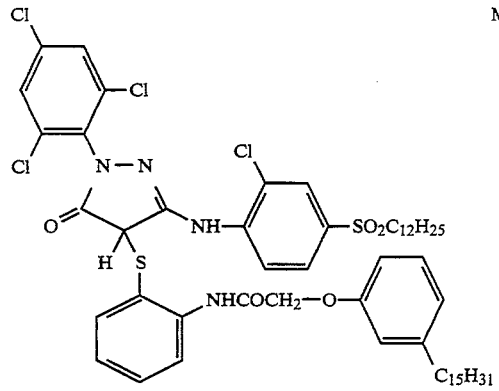

Preparation of Dispersion 2 (comparative):

This dispersion was prepared in the same manner as dispersion 1 except that tricresyl phosphate was used in place of dibutyl phthalate.

Preparation of Dispersion 3 (invention):

1.4 grams of dibutyl phthalate was heated to 140° C. in a heating mantle. 3.4 grams of M-1 was added to the solvent followed by 2.0 grams of R-A. The remainder of the procedure was similar to that for Dispersion 1.

Preparation of Dispersion 4 (comparative):

1.4 grams of dibutyl phthalate was heated to 140° C. in a heating mantel. 3.4 grams of M-1 was added to the solvent followed by 12.27 grams of a 16.3% w/w solution of a copolymer of butyl acrylate and acrylic acid (90:10 by weight) in ethyl acetate. The ethyl acetate was allowed to evaporate. The remainder of the procedure was similar to that for Dispersion 1.

The dispersions were combined with emulsion and coated on a paper support. The coating format is shown below. The numbers indicate coverages in g/m$^2$.

| Overcoat gel |
|---|
| 0.17 Ag |
| 0.353 M-1 |
| 0.81 gel |
| Paper Support |

35 mm strips were obtained from the coatings. The strips were exposed using a 0–3 density 21 step tablet and were processed using the standard RA-4 process. Processed strips from each coating were subjected to 50 Klux high intensity daylight (HID) radiation for five days to determine image stability. Given below is a summary of the fresh Dmax and the change (Δ) in blue density in the Dmin area after five days exposure to 50 Klux HID radiation.

| Dispersion # | Fresh Dmax | Δ Dmin Blue |
|---|---|---|
| 1 comparative | 2.5 | 0.14 |
| 2 comparative | 2.5 | 0.17 |
| 3 invention | 2.4 | 0.04 |
| 4 comparative | 1.4 | 0.10 |

It is clear that the method of the invention gives good color reproduction and excellent image stability.

EXAMPLE 2

This example illustrates the effect of R-A on fading of a magenta image dye.

Preparation of a Dispersion 5 (comparative):

A dispersion of the magenta image dye Dye 1 was prepared in the following manner. 0.5 grams of dibutyl phthalate was combined with 0.5 grams of Dye 1 and 20 grams of ethyl acetate to constitute the oil phase. The aqueous phase was prepared by combining 32.9 grams of a 11.48% w/w solution of Type IV gelatin in water with 5.0 grams of 10% w/w solution of the surfactant Alkanol XC TM and 50.0 grams of distilled water. The aqueous phase was combined with the oil phase while stirring and the mixture was passed three times through a colloid mill to obtain the dispersion. The ethyl acetate was then removed from the dispersion by evaporation at 60° C. and reduced pressure.

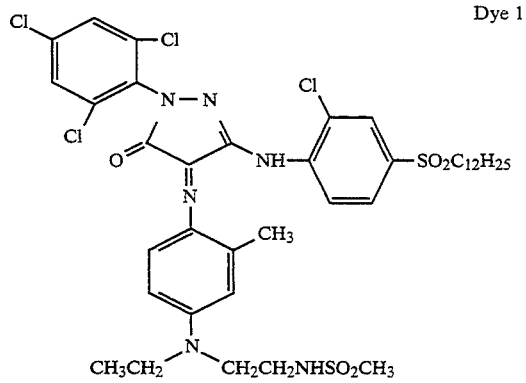

Preparation of Dispersion 6 (invention):

This was prepared in the same manner as Dispersion 5 except that the oil phase was made by combining 0.2 grams of dibutyl phthalate with 0.5 grams of Dye 1, 0.3 grams of R-A and 20 grams of ethyl acetate.

The dispersions were coated on a paper support to give a coverage of 10 mg of dye per ft$^2$ An ultraviolet light protection layer was coated above the layer containing the dye. The coatings were exposed to Klux high intensity daylight radiation and the extent of dye fade was determined. The latter is reported as a percentage of the initial density; i.e. dye fade={(Di-Df)/Di)×100 where Di is the initial status A green density and Df is the final density.

| Dispersion # | Dye Fade |
|---|---|
| 5 comparative | 61.3 |
| 6 invention | 40.9 |

It is clear that the method of the invention results in a significant improvement in dye fade.

EXAMPLE 3

Preparation of Dispersion 7 (comparative):

A dispersion of the magenta coupler M-1 was prepared in the following manner. 3.4 grams of dibutyl phthalate was heated to 140° C. in a heating mantel. 3.4 grams of the coupler was then dissolved in the solvent to constitute the oil phase. The aqueous phase was prepared by combining 44 grams of a 11.36% w/w solution of Type IV gelatin in water with 5 grams of 10% w/w solution of Alkanol XC TM and 44.2 grams of distilled water. The aqueous phase was maintained at 65° C. The aqueous phase was combined with the oil phase and the mixture was passed twice through a microfluidizer at 7200 psi to obtain the dispersion.

Preparation of Dispersion 8 (Comparative):

A dispersion of the magenta coupler M-2 was prepared in the same manner as above except that M-2 was used in place of M-1.

M-2

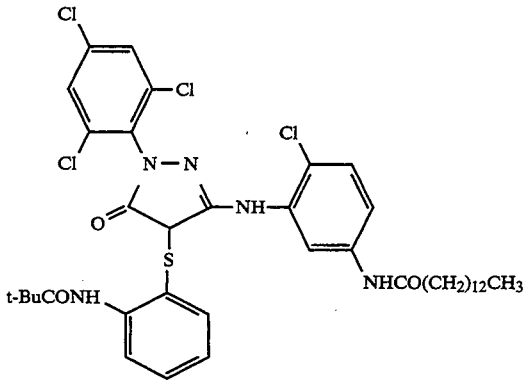

Preparation of Dispersion 9 (comparative):

A dispersion of the magenta coupler M-3 was prepared in the same manner as Dispersion 7 except that M-3 was used in place of M-1.

M-3

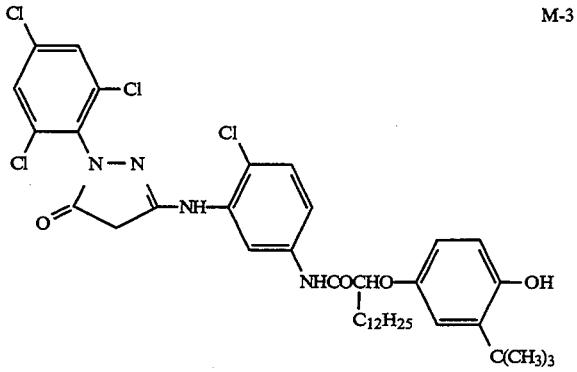

Preparation of Dispersion 10 (invention):

This was prepared in the following manner. 1.7 grams of dibutyl phthalate was heated to 140° C. in a heating mantel. 3.4 grams of the coupler M-1 and 1.7 grams of R-A were then dissolved in the solvent to constitute the oil phase. The remainder of the preparation was the same as that described under Dispersion 7.

Preparation of Dispersion 11 (invention):

This was prepared in the same manner as Dispersion 10 except the M-2 was used in place of M-1.

Preparation of Dispersion 12 (invention):

This was prepared in the same manner as Dispersion 10 except the M-3 was used in place of M-1.

The dispersions were combined with emulsion and coated on a paper support. The format is shown below. The numbers indicated relative weight coverages.

| Overcoat gel |
|---|
| UV Protection Layer |
| 1.33 gel |
| 0.17 Ag |
| 0.353 M-1 |
| 0.81 gel |
| Paper Support |

Unexposed strips based on the above coatings were processed by the standard RA-4 process and then exposed to 50 Klux high intensity daylight radiation for two weeks. The change in Status A blue density was noted.

| Dispersion # | Δ Blue Density |
|---|---|
| 7 comparative | 0.11 |
| 8 comparative | 0.04 |
| 9 comparative | 0.08 |
| 10 invention | 0.02 |
| 11 invention | 0.00 |
| 12 invention | 0.02 |

It is clear that the method of the invention results in significant improvement in photochemical yellowing.

EXAMPLE 4

Preparation of Dispersion 13 (comparative):

A dispersion of M-1 was prepared in the same manner as dispersion 1 except that S 1 was used in place of dibutyl phthalate.

S-1

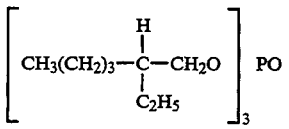

Preparation of Dispersion 14 (invention):

This dispersion was prepared in the same manner as Dispersion 3 except that S-1 was used in place of dibutyl phthalate.

The dispersions were coated in the same format as described under Example 1. 35 mm strips were obtained from the coatings. Unexposed strips were processed using the standard RA-4 process and then subjected to 50 Klux high intensity daylight (HID) radiation for three days. Given below is the change in status A blue density following exposure to the high density radiation.

| Dispersion # | Δ Dmin Blue |
|---|---|
| 13 comparative | 0.14 |
| 14 invention | 0.04 |

Once again the method of the invention gives significant improvement in photochemical yellowing.

EXAMPLE 5

Preparation of Dispersion 15:

A dispersion of the magenta coupler M-1 was prepared in the following manner. 21 grams of S-1 and 15.9 grams of ST-1 were heated to 140° C. in a heating mantel. 18 grams of the coupler and 4.8 grams of ST-2 were then added. The resulting oil phase was stirred until all components were dissolved. The aqueous phase was prepared by combining 257 grams of a 11.67% w/w solution of Type IV gelatin with 30 grams of a 10% w/w solution of the surfactant Alkanol XC TM and 253 Grams of distilled water. The aqueous phase was maintained at 65° C. The aqueous phase was combined with the oil phase and the mixture was passed twice through a microfluidizer at 10,000 psi to obtain the dispersion.

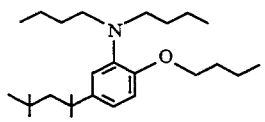

ST-1

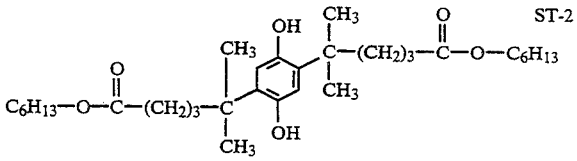

ST-2

Preparation of Dispersion 16

A dispersion of gum rosin (obtained from Aldrich Chemical) was prepared in the following manner. 10 grams of dibutyl phthalate was heated to 140° C. in a heating mantel. 20 grams of gum rosin was added and the mixture was stirred until all the rosin had dissolved. The aqueous phase was prepared by combining 103 grams of a 11.67% w/w solution of Type IV gelatin with 20 grams of a 10% w/w solution of the surfactant Alkanol XC TM and 247 grams of distilled water. The aqueous phase was maintained at 65° C. The aqueous phase was then combined with the oil phase (i.e., the solution of gum rosin and dibutyl phthalate) and the mixture passed twice through a microfluidizer at 10,000 psi to obtain the dispersion.

The dispersions were coated in the following formats. The numbers indicate relative weight coverages.

| Overcoat | Overcoat |
|---|---|
| 1.40 gelatin | 0.86 gum rosin |
| | 0.54 gelatin |
| 0.17 Ag | 0.17 Ag |
| 0.353 M-1 | 0.353 M-1 |
| 1.27 gelatin | 1.27 gelatin |
| 1.40 gelatin | 0.86 gum rosin |
| | 0.54 gelatin |
| Paper Support | Paper Support |
| Coating #1 | Coating #2 |

In this experiment, dispersions 15 and 16 were coated in separate layers. specifically the gum rosin was coated in non-imaging layers adjacent to the magenta imaging layer (see Coating #2, above). 35 mm strips based on Coating #1 and Coating #2 were exposed using a 21 step tablet and processed by the standard RA-4 process. A set of processed strips were subjected to 50 Klux high intensity daylight (HID) radiation for four days. A second set of processed strips were incubated at 77° C. and 60% relative humidity (RH) for two weeks. Given below is the change in blue Dmin (photochemical yellowing) following exposure to the high intensity radiation and the change in green Dmin (thermal pinking) following incubation in the oven.

| Coating # | Δ Dmin Blue | Δ Dmin Green |
|---|---|---|
| 1 (control) | 0.14 | 10.11 |
| 2 (invention) | 0.04 | 0.08 |

It is clear that the method of the invention provides significant improvement in both photochemical yellowing and thermal pinking.

The invention has been described in detail with particular reference to preferred embodiments thereof, but it is to be understood that variations and modifications can be effected within the spirit and scope of the invention.

What is claimed is:

1. A silver halide color photographic element comprising at least one light sensitive layer comprising water, a silver halide emulsion, a hydrophilic colloid and a dispersed oil phase comprising at least one non-color forming, oil-soluble, monomeric or oligomeric organic compound having having a molecular weight below about 1,000 and a glass transition temperature between 0° and 150° C.

2. A photographic element according to claim 1 which comprises a plurality of light sensitive layers including at least one layer sensitive to red light and comprising a silver halide emulsion and a cyan dye forming coupler, at least one layer sensitive to green light and comprising a silver halide emulsion and a magenta dye forming coupler and at least one layer sensitive to blue light and comprising a silver halide emulsion and a yellow dye forming coupler and said organic compound is in at least one of said light sensitive layers.

3. A photographic element according to claim 2, wherein said organic compound is in the blue sensitive layer.

4. A photographic element according to claim 2, wherein said organic compound is in the green sensitive layer.

5. A photographic element according to any one of claims 1 through 4, wherein said organic compound is selected from the group consisting of oil-soluble gums, rosins, rosin derivatives, natural resins and derivatives thereof, and oil-soluble sucrose derivatives.

6. A photographic element according to claim 5, wherein the organic compound is a rosin derivative.

7. A photographic element according to claim 6, wherein the rosin derivative is a compound or the formula:

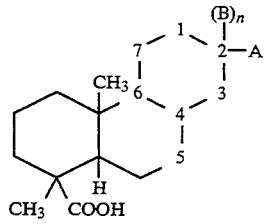

where A is a saturated or unsaturated alkyl group of 1–10 carbons; B is a hydrogen atom or a saturated or unsaturated alkyl group of 1–10 carbons and n is 0 or 1; and bonds between the numbered corners of the ring structure are single or double bonds.

8. A photographic element according to claim 6, wherein the rosin derivative is abietic acid.

9. A photographic element according to claim 5, wherein the organic compound is sucrose octaacetate.

10. A photographic element according to claim 1, which further comprises an oil-soluble polymer.

11. A silver halide color photographic element comprising at least one light sensitive layer comprising water a silver halide emulsion, a hydrophilic colloid and a dispersed oil phase comprising a rosin or a derivative thereof.

12. A method of improving the image stability of a silver halide color photographic element comprising at least one light sensitive layer comprising water, a silver halide emulsion, and a hydrophilic colloid which method comprises incorporating in said layer a dispersed oil phase comprising at least one non-color forming, oil-soluble, monomeric or oligomeric organic compound having a molecular weight below about 1,000 and a glass transition temperature between 0° and 150° C.

* * * * *